US006988780B2

(12) United States Patent
Anderson et al.

(10) Patent No.: US 6,988,780 B2
(45) Date of Patent: Jan. 24, 2006

(54) WALL CABINET ASSEMBLY

(75) Inventors: Torrence Anderson, Overland Park, KS (US); Brian Moon, DeKalb, IL (US)

(73) Assignee: Suncast Corporation, Batavia, IL (US)

( * ) Notice: Subject to any disclaimer, the term of this patent is extended or adjusted under 35 U.S.C. 154(b) by 266 days.

(21) Appl. No.: 10/666,494

(22) Filed: Sep. 17, 2003

(65) Prior Publication Data

US 2005/0057128 A1 Mar. 17, 2005

(51) Int. Cl.
*A47B 47/00* (2006.01)

(52) U.S. Cl. ..... 312/323; 312/322; 312/257.1

(58) Field of Classification Search ..... 312/257.1, 312/265.5, 265.6, 322, 323, 326
See application file for complete search history.

(56) References Cited

U.S. PATENT DOCUMENTS

| | | | | |
|---|---|---|---|---|
| 644,434 A | | 2/1900 | Macey | |
| 657,017 A | | 8/1900 | Tobey | |
| 726,411 A | | 4/1903 | Knight | |
| 726,957 A | | 5/1903 | Macey | |
| 1,288,665 A | | 12/1918 | Page | |
| 2,258,948 A | | 10/1941 | Garrison | |
| 3,339,995 A | | 9/1967 | Bencene | |
| 3,716,282 A | * | 2/1973 | Propst et al. | 312/322 |
| 3,748,005 A | | 7/1973 | Chovanec et al. | |
| 3,794,401 A | | 2/1974 | Dean et al. | |
| 4,265,502 A | | 5/1981 | Blodee et al. | |
| 4,314,734 A | * | 2/1982 | Grunert | 312/322 |
| 4,375,907 A | | 3/1983 | Vander Kooi et al. | |
| 4,441,771 A | * | 4/1984 | Roesler | 312/322 |
| 4,600,254 A | | 7/1986 | Whalen | |
| 4,641,896 A | | 2/1987 | Iimura et al. | |
| 4,971,404 A | | 11/1990 | Klungle et al. | |
| D339,934 S | | 10/1993 | Reuter | |
| 5,335,987 A | | 8/1994 | Hodge et al. | |
| 5,520,451 A | | 5/1996 | Oshima | |
| 5,845,980 A | | 12/1998 | Fricano et al. | |
| 5,957,558 A | | 9/1999 | Quade | |

FOREIGN PATENT DOCUMENTS

| | | | | |
|---|---|---|---|---|
| FR | 1099359 | * | 9/1955 | 312/323 |

* cited by examiner

*Primary Examiner*—James O. Hansen
(74) *Attorney, Agent, or Firm*—McHale & Slavin, P.A.

(57) ABSTRACT

A self-fastening wall cabinet including a plurality of panels having integrated connectors, and a flipper door. The plurality of panels are formed of injection molded plastic and interlock with one another to assemble the wall cabinet without the need for separate fasteners or connectors.

16 Claims, 6 Drawing Sheets

WALL CABINET ASSEMBLY

FIELD OF THE INVENTION

This invention relates generally to a wall cabinet assembly constructed of injection molded plastic structural panels. More specifically, the present invention relates to a wall cabinet with a flipper door which is capable of being packaged and shipped in a knocked-down state and constructed into a secure wall cabinet at a desired site.

BACKGROUND INFORMATION

Throughout the home, a need exists to store a large variety of different items. This is particularly true of garage and utility areas where a vast array of products have been developed to increase the comfort level of living. The accumulation of these various objects and products gives rise to a need for adequate storage of those items when not in use.

Various cabinets for storing household items such as gardening tools, automotive supplies, barbeque accessories and the like are well known. One of the more popular types of cabinets for storing household items is a wall cabinet with a flipper door. Cabinets with flipper doors are well-known in the prior art. Flipper doors are opened by pulling the bottom of the door upward in a 90 degree arc such that the door is parallel to the top wall of the cabinet. The flipper door is then slid into the opening adjacent the top wall such that the opening is completely exposed. The movement of the flipper door is usually accomplished through use of a rack and pinion assembly. Usually the rack is located on the inside of the sidewalls of the cabinet, while the pinion is connected to an axle or rod which is attached to the door by brackets or hinges. Illustrative of such cabinets with flipper door systems are U.S. Pat. No. 644,434 to Macey; U.S. Pat. No. 657,017 to Tobey; U.S. Pat. No. 726,411 to Knight; U.S. Pat. No. 726,957 to Macey; U.S. Pat. No. 761,312 to Luellen; U.S. Pat. No. 1,288,665 to Page; U.S. Pat. No. 3,339,995 to Bencene; U.S. Pat. No. 3,748,005 to Chovanec et al; U.S. Pat. No. 3,794,401 to Dean et al; U.S. Pat. No. 4,265,502 to Blodee et al; U.S. Pat. No. 4,375,907 to Vander Kooi et al; U.S. Pat. No. 4,600,254 to Whalen; and U.S. Pat. No. 4,641,896 to Iimura et al.

Cabinets including drop doors and counterbalanced doors are also well known in the art, and are often preferred over other cabinets because the doors are less likely to produce the guillotine effect which may be caused by heavier flipper doors.

U.S. Pat. No. 2,258,948 to Garrison describes a bookcase unit with a drop door which uses a rack and pinion system similar to that used with a flipper door. However, instead of the door swinging outward and being stored adjacent to the top wall, the rack and pinion system is used to drop the door vertically down past the bottom of the unit. The pinion is attached to a rod which extends through loops in the hinges located at the top of the door. A runway located on the front inner sides of the bookcase contains a deep portion and a shallow portion. The shallow portion contains the rack which coacts with the pinion and allows the door to drop smoothly. The deep portion is engaged by the end of the rod which extends through the pinion. A spring is also provided around the rod which assists to counteract the effects of gravity and to achieve a more gradual dropping of the door. This door style lacks the space saving feature of the flipper door and tends to hinder access to lower cabinets or shelves.

U.S. Pat. No. 6,557,958 to Motta et al. discloses a storage bin with a counterbalanced door. The assembly includes panels forming a bin or cabinet, and a flipper door operably attached to the bin by a pair of opposing modules. Each module includes a body forming a groove in the form of a curvilinear track along its upper edge, and the door includes a follower operably engaging the track. Each module further includes a spring biased lever pivoted to the body of the module at a mid-lever point. A first leg of the lever is pivoted to the door at a door pivot point, and an oppositely extending second leg is connected to a spring biased force generating device. The arrangement is constructed to counterbalance the door in most intermediate positions.

Cabinets including an over-the-top door are also well known in the art and are often preferred over other cabinets because the doors do not take up space within the cabinet when opened. Such cabinets and doors often use a sliding hinge arrangement, where a pair of hinges are attached to the top and front of the cabinet and a track is attached to a side of the door for both slidably and pivotally engaging the hinge. The door opens by sliding the door upwardly and/or outwardly until the door can be slid onto the top of the cabinet for storage in an open position.

A problem is that these pivot/slide hinged doors can close with guillotine-like motion if the doors are prematurely released when partially open. This results in the doors moving vertically downwardly by gravity with a potentially unsafe speed and force unless proper care is used. Some cabinet manufacturers have conceived of alternatives to reduce the potential or likelihood of such accidental downward movement of the doors. However, the known alternatives are costly, include an unacceptable number of components, are mechanically too complex, and/or are difficult to assemble.

U.S. Pat. No. 4,615,570 to Goodman describes a cabinet with a flipper door which is stored horizontally above the top wall of the cabinet when in the open position. The flipper door is operated by a rack and pinion assembly. The rack is located on the upper inside wall of the cabinet and includes a lower guide channel. The pinion gears are rotatably coupled to each other by a transverse axle. The terminal ends of the axle extend through the pinion gears and slidably engage the lower guide channel. The flipper door of the cabinet is larger than the cabinet opening in order to cover the edges of the side walls when the door is closed. The rack is also provided with an upper guide channel. A link is attached between the transverse axle of the rack and pinion assembly and the door hinges. The stud shaft which secures the link to the hinge extends past the link to slidably engage the upper guide channel and to create a pivot axis which is shifted forward a sufficient amount to accommodate the extra width of the flipper door. The configuration of the door in this reference requires extra space above the cabinet for the door which also prevents stacking of the cabinets. U.S. Pat. No. 6,007,171, to Varellas-Olree discloses a cabinet assembly with an over the top door. The assembly includes a cabinet, a follower, and a mating guide. The cabinet is configured with a front opening. The door is configured to close the front opening. The sliding hinge structures operably support the door on the cabinet for pivotal and sliding movement between a closed position covering the front opening, and an open position uncovering the front opening and storing the door above the cabinet. The follower and the mating guide are separate from the hinge structures and operably attach an upper edge of the door to a front edge of the cabinet. The follower and guide constrain the door to a pivotal movement as the door is initially opened to prevent a sliding guillotine-like movement when the door opened.

Such prior art systems fail to meet all of the needs of manufacturers to provide a product that can be easily manufactured, packaged and shipped, or the needs of consumers requiring structural integrity combined with modularity and aesthetic appearance. Moreover, because these devices do not break down they are difficult to ship from the manufacturer to the consumer.

Paramount among such needs is a panel system which creates cabinet walls which resist panel separation, buckling and racking. Structure is a further consideration; the cabinet formed by the panels must tie into the flipper door and back panel in such a way as to unify the entire enclosure. Also, from a versatility standpoint, a flipper door should be present which can be easily opened and closed after assembly of the side, top, bottom and back panels, and which provides security and dependable pivoting access to the contents of the wall cabinet without the guillotine-like motion associated with the prior art.

There are also commercial considerations that must be satisfied by any viable wall cabinet system or kit; considerations which are not entirely satisfied by state of the art products. The wall cabinet must be formed of relatively few component parts that are inexpensive to manufacture by conventional techniques. The wall cabinet must also be capable of being packaged and shipped in a knocked-down state.

In addition, there are ergonomic needs that a wall cabinet system must satisfy in order to achieve acceptance by the end user. The system must be easily and quickly assembled using minimal hardware and requiring a minimal number of tools. Further, the system must not require excessive strength to assemble or include heavy component parts. Moreover, the system must assemble together in such a way so as not to detract from the internal storage volume of the resulting wall cabinet or otherwise negatively affect the utility of the wall cabinet.

BRIEF DESCRIPTION OF THE INVENTION

The present invention provides an assembly, or kit, of injection molded panels having integrated connectors which combine to form a wall cabinet with a flipper door. The panels are formed to interlock with one another without the need for separate fasteners or connectors. The system incorporates a minimum number of components to construct a wall cabinet by integrally forming the connectors into the injection molded panels. This minimizes the need for separate connectors or fasteners to assemble the wall cabinet. The integrated connection of the side wall, cover and bottom panel components also simplifies the wall cabinet construction. Injection molding allows the panels to be formed with integral cross-bracing, ribs and gussets for increased rigidity. When supplied as a kit, assembly of the wall cabinet requires minimal hardware and a minimum number of hand tools.

The left and right side wall panels are constructed with outwardly extending contoured locking posts for interlocking cooperative engagement with sockets in the ends of the like-constructed top and bottom panels. The engagement between the locking posts and the sockets serve to rigidly connect the components together. The assembly includes a rear panel which interlocks into grooves integrally formed into the left, right, top and bottom panels to prevent the panel from bowing inwardly or outwardly to provide security and aesthetic appearance. The rear panel includes a plurality of keyhole slots to allow the assembled cabinet to be easily and securely attached to a wall. The interior of the wall cabinet assembly includes two integrally molded tracks which extend front to rear along the upper portion of each side panel. Each track is constructed to accept D-shaped pin members which define an axis of rotation and which extend outwardly from each side of the upper portion of the flipper door. The cooperation between the tracks and the D-shaped pins only allow the flipper door to be rotated while it is in its farthest forward position, and only allow the flipper door to be slid into the cabinet while the door has been rotated about the axis to an essentially horizontal position such that the door is generally parallel to the top wall of the cabinet. This construction allows the flipper door to be secured across the opening of the cabinet while in the closed position, and allows the flipper door to be slid into the cabinet to an essentially juxtaposed position beneath the top panel such that the opening is completely exposed.

Accordingly, it is an objective of the present invention to provide a wall cabinet system having a flipper door which operates via a novel hinge and slider track assembly.

It is a further objective of the present invention to provide a guide device, by which a flipper door can be smoothly guided inwardly into a cabinet body, and the flipper door can be received sufficiently far into the cabinet body to provide access to the interior of the cabinet.

Yet a further objective of the present invention is to provide a wall cabinet system constructed from panels having integrated connectors which accommodate injection molding plastic formation of the panel components for increased structural integrity.

Another objective of the present invention is to provide a wall cabinet storage system in which the side walls, top panel, and bottom panel are interlocked without the need for separate fasteners.

Yet another objective of the present invention is to provide a kit for a wall cabinet that is capable of being packaged and shipped in a knocked-down state and constructed into a secure cabinet.

Other objectives and advantages of the present invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENTS

Figure 1:
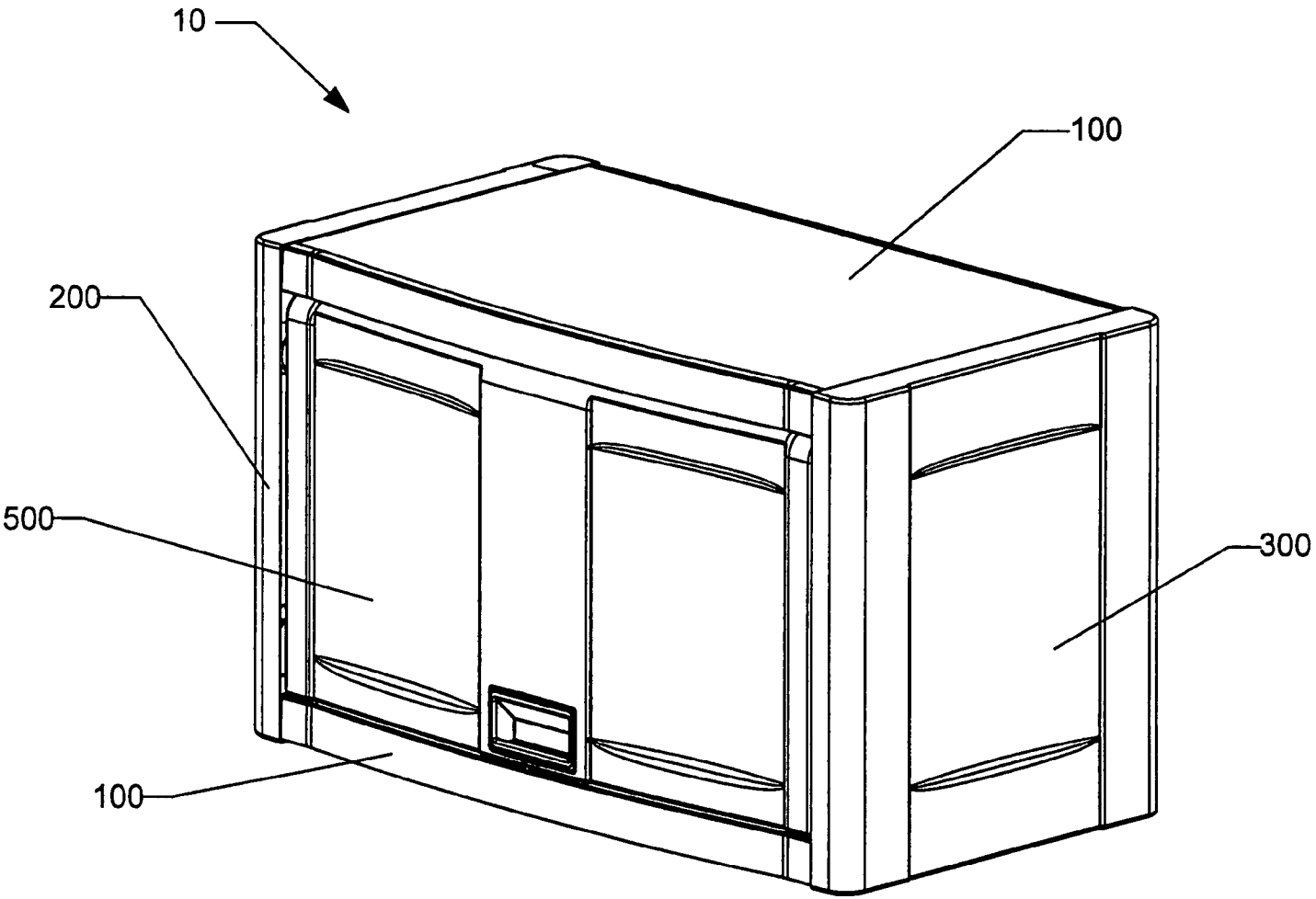
FIG. 1 is a perspective view of the instant invention.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiments illustrated.

FIGS. 1–5 which are now referenced illustrate perspective and exploded views of the wall cabinet assembly, generally referenced as 10, according to a preferred embodiment of the present invention. The wall cabinet generally includes like-constructed top and bottom panels 100, left side panel 200, right side panel 300, rear panel 400 (FIG. 2), and flipper door panel 500. In the preferred embodiment, the panels comprising the assembly are formed of, but not limited to, a suitable polymeric material through the process of injection molding. The result is that the panels comprising the wall cabinet assembly 10 are formed as unitary panels with integral connectors and cross bracing. Strengthening ribs 102, 202 (FIG. 2) are integrally formed within the inner and lower surfaces respectively of the side, top, and bottom panels in order to enhance rigidity of the panels while leaving the external surface in a generally smooth condition for aesthetic purposes, as shown in FIG. 1. The top and bottom panels 100 have an upper surface 104, lower surface (not shown), front edge 106, rear edge 108, and like-constructed left edge 112 and right edge 114. Adjacent to each of the left and right edges 112, 114 is a means of attaching the top and bottom panels to the left side panel 200 and right side panel 300, illustrated as a plurality of formed sockets 116 extending inwardly from each end. The formed sockets 116 are constructed and arranged to cooperate with locking posts 210 extending outwardly along the inner surfaces 204 of the left and right side panels 200, 300. The locking posts 210 and sockets 116 are constructed and arranged so that the locking posts 210 enter and mateably engage the sockets 116 securing the panels together in an inter-fitting perpendicular engagement. The upper and lower surfaces 104 of the top and bottom panels 100 are also constructed with a groove 118 extending from about the left end 112 to about the right end 114 of the panels. The groove 118 is constructed and arranged to cooperate with the rear panel 400. The cooperating engagement between the rear panel 400 and the grooves 118 increases the structural integrity of the wall cabinet assembly 10 by preventing the rear panel 400 from bowing or bending inwardly or outwardly, and thus, adversely affecting the appearance or operation of the wall cabinet assembly 10.

The inner surfaces 204 of the left and right side wall panels 200 and 300 are each configured having an upper portion 208 and a lower portion 212. Both portions 208, 212 include an integrally formed attachment means illustrated herein as outwardly extending locking posts 210. The locking posts 210 are generally constructed and arranged to cooperate with the sockets 116 provided in either end of the top and bottom panels 100.

The outer surface of the panels 200, 300, 400, 500 and the upper surface of the panels 100 are constructed generally smooth and may be bowed inwardly for added strength and aesthetic appearance. The inner surfaces of the panels 200 and 300 and the lower surfaces of the panels 100 are constructed with a plurality of strengthening ribs 202 and 102, respectively, extending across the panels, and may additionally be provided with a plurality of gussets (not shown) to further strengthen the panels. The ribs and gussets increase the structural integrity of the wall cabinet assembly 10 by preventing the panels 100, 200, and 300 from bowing or bending inwardly or outwardly, and thus, adversely affecting the appearance or operation of the wall cabinet 10. The integrally formed ribs 102, 202 and optional gussets are facilitated by injection molding. Injection molding offers significant strength and stability advantages over wood or metal construction as utilized in the prior art. In this manner, the enclosure of the instant invention is capable of handling a significant amount of weight as compared to wooden or sheet metal cabinets.

The left and right side panels 200, 300 are attached to the top and bottom panels 100 by inserting the locking posts 210 into formed sockets 116 until the spring tabs 214 integrally formed into the locking posts 210 engage the apertures 120 in the sockets 116 of the top and bottom panels 100. It will be appreciated that the purpose of the locking posts 210 are to align two panels in a perpendicular relationship and to facilitate their mechanical connection. The perpendicular panels are brought into an overlapping relationship wherein the locking posts 210 enter the corresponding socket 116 in the top and bottom panels 100. The result is a coupling engagement between the two panels. The overlapping edges between the panels as described above provide a secure connection and offer several advantages. First, the design allows the panels to be connected without the need for separate fasteners. Second, the design creates a positive lock that prevents separation of the panels. Third, the design maintains alignment of the panels in the same plane and prevents bowing or bending of either panel relative to one another. The resultant wall cabinet created by the combination of the interlocking panels benefits from high structural integrity and reliable operation.

Figure 2:
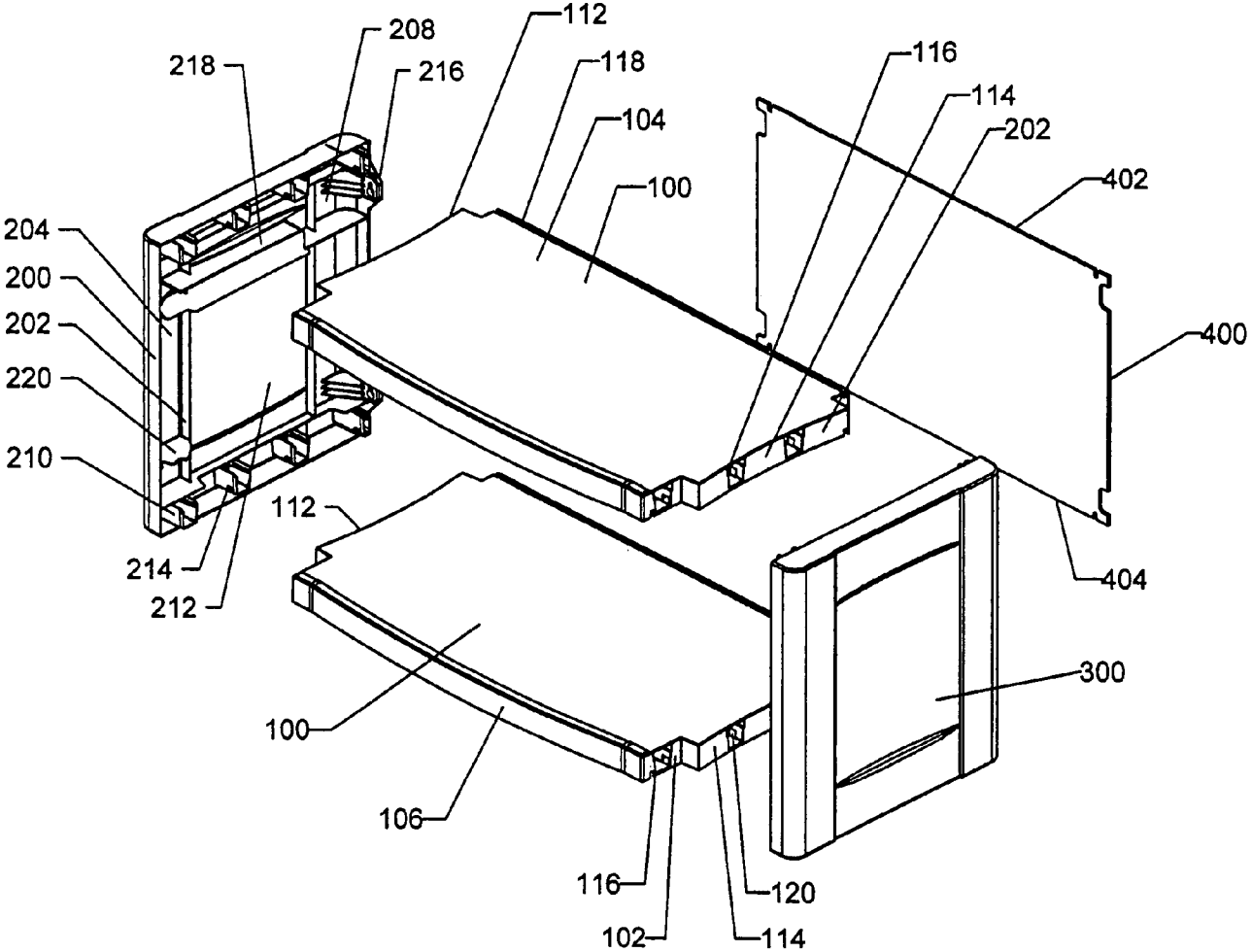
FIG. 2 is an exploded view of the instant invention illustrated with the flipper door omitted for clarity.
Figure 3:
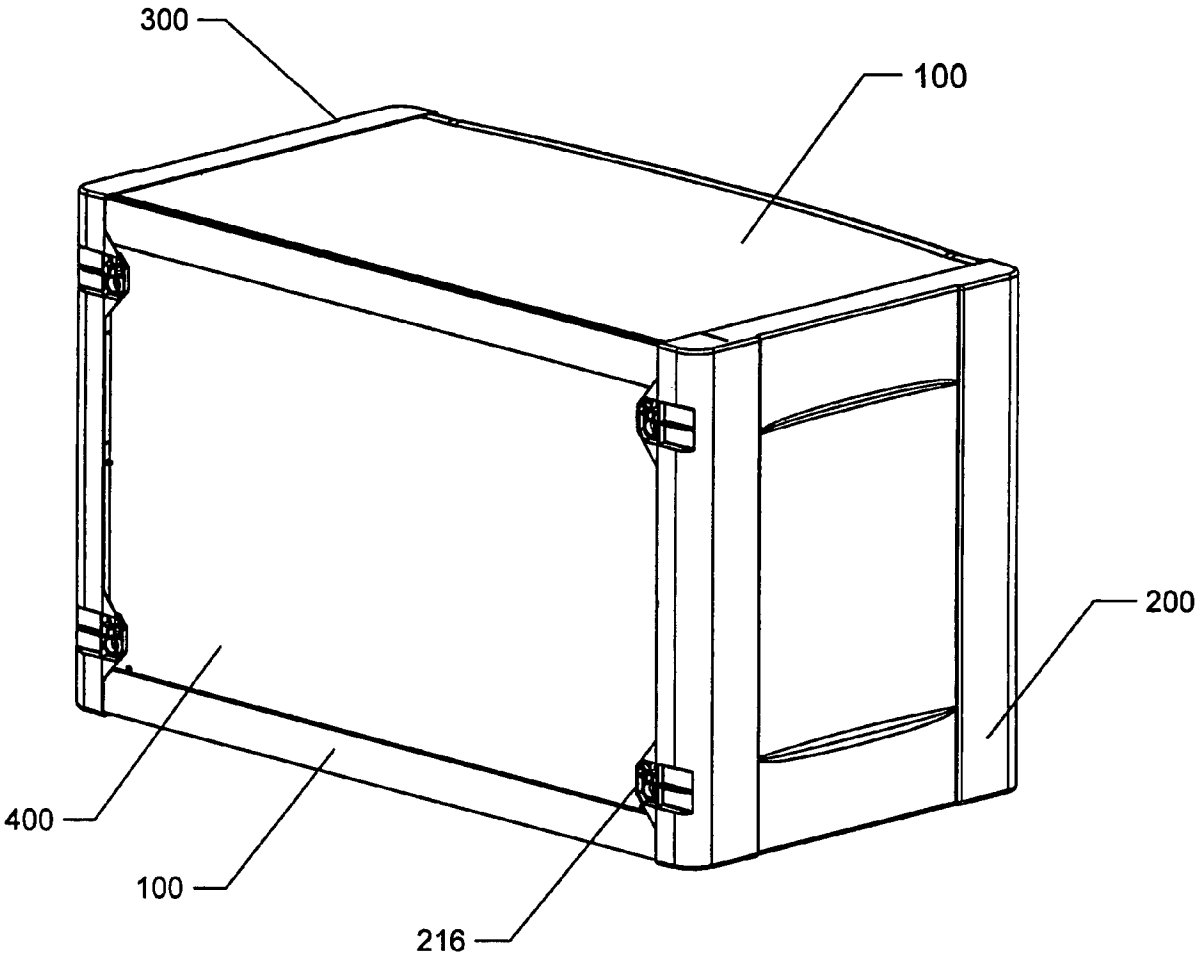
FIG. 3 is a perspective view of the back of the instant invention.

Referring to FIGS. 2 and 3, the rear panel 400 is attached to the top and bottom panels 100 by sliding the upper and lower edges 402, 404 into the corresponding grooves 118 in the upper and lower surfaces of the top and bottom panels 100. The grooves 118 in the top and bottom panels 100 correspond in shape and size to that of the upper and lower rear panel edges to engage the rear panel 400. The result is a positive mechanical connection between the rear panel 400 and the top and bottom panels 100.

Figure 6:
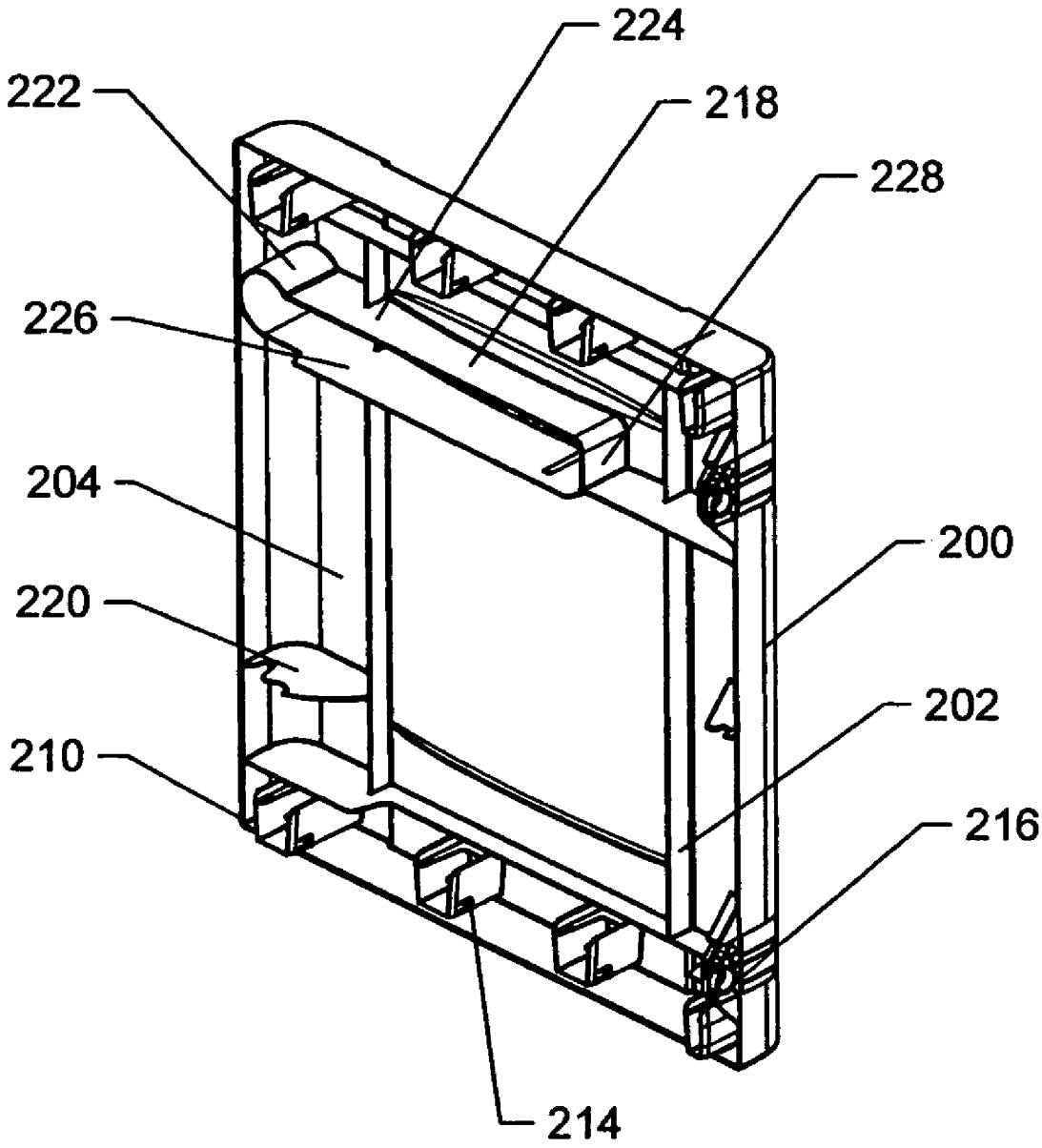
FIG. 6 is a perspective view of the inner surface of the left side panel of the instant invention.

Referring to FIGS. 3 and 6, the wall cabinet mounting means is illustrated. The wall cabinet mounting means is illustrated herein in a non-limiting embodiment as a plurality of integrally formed keyhole slots 216. The keyhole slots 216 depend inwardly from the rear portion of the left side panel 200 and right side panel 300. The keyhole slots are adapted to allow the wall cabinet to be easily mounted and dismounted from a wall surface. In operation, a minimum of two and preferably four fasteners are locationally arranged and attached to a wall surface. The wall cabinet keyhole slots 216 are thereafter slid over the heads of the fasteners (not shown) and the wall cabinet is slid downward a small amount. The cooperation between the keyhole slots and the fasteners holds the wall cabinet assembly 10 securely to the wall surface.

Figure 4:
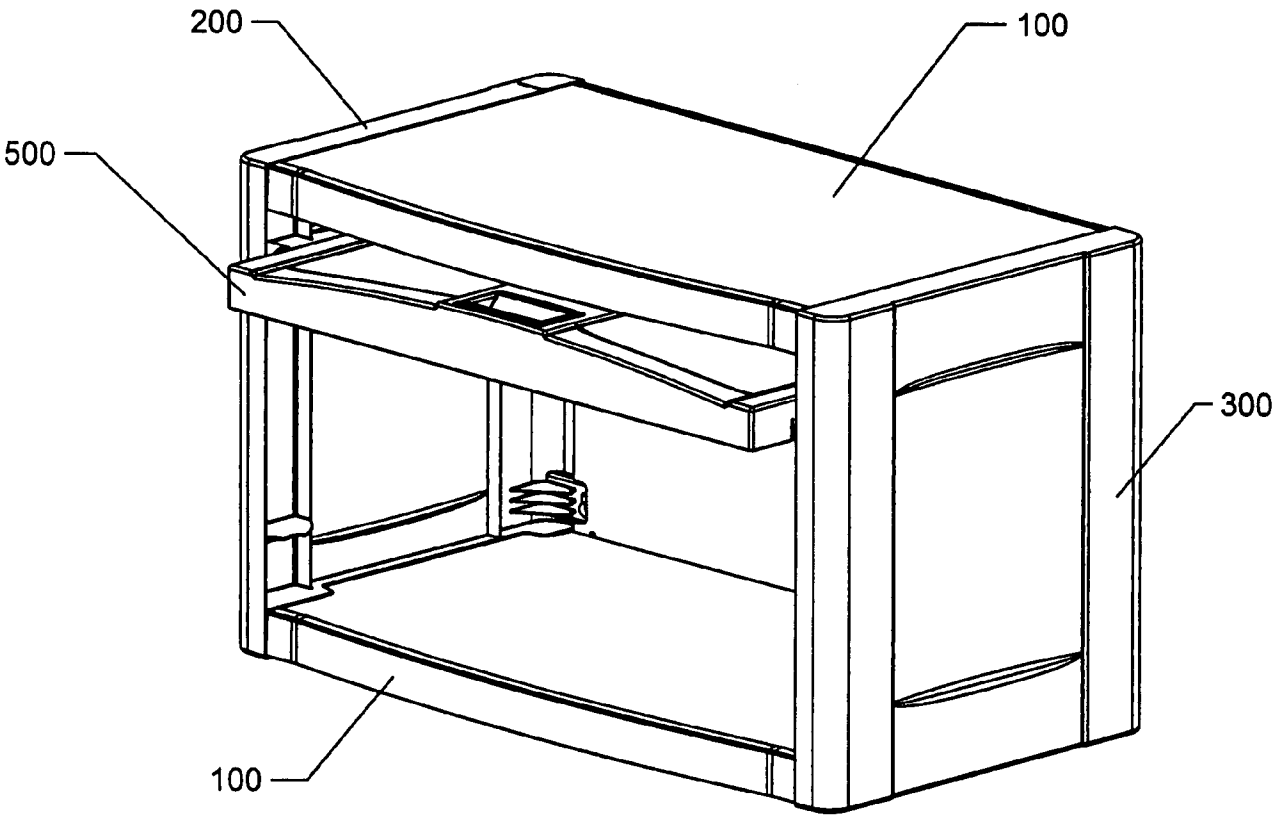
FIG. 4 is a perspective view of the instant invention, illustrated with the flipper door in the open position.
Figure 5:
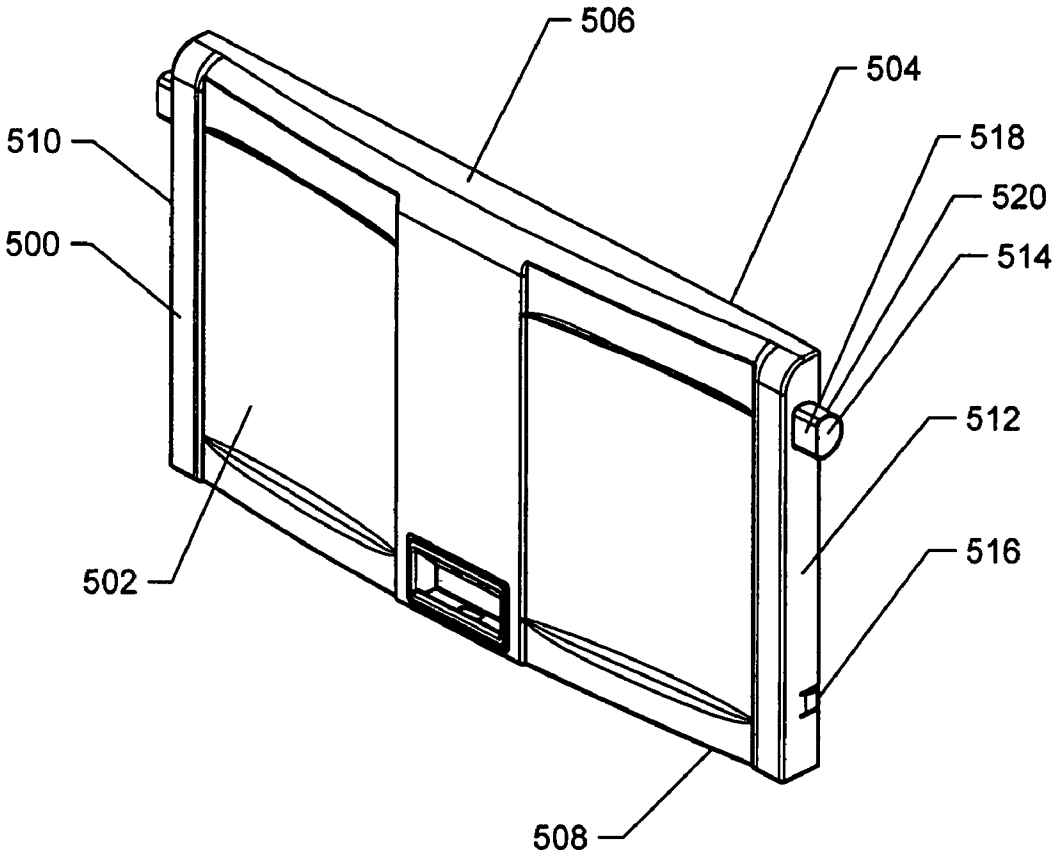
FIG. 5 is a perspective view of the flipper door of the instant invention.

Referring to FIGS. 4 and 5, the flipper door 500 is illustrated. The flipper door 500 is generally constructed and arranged for enclosing the front of the wall cabinet 10. The flipper door 500 includes an outer surface 502, an inner surface 504, a top edge 506, a bottom edge 508, a left edge 510, and a right edge 512. The left edge 510 and the right edge 512 each include a pivot means, illustrated herein as a D-shaped pin member 514 which defines an axis of rotation and extend outwardly from the upper portion thereof. The D-shaped pin members are generally constructed and arranged to cooperate with the left and right side panel tracks 218 (FIG. 6) to allow the lower edge 508 of the flipper door 500 to rotate about the axis to an essentially horizontal position when in a forward most position and thereafter slide inwardly in a generally parallel and adjacent manner to the lower surface of the top panel 100 along the track 218 and to an essentially juxtaposed position beneath the top panel to provide ingress into the wall cabinet. The flipper door 500 is also provided with a latch means for releasably securing the flipper door in a lowered position across the wall cabinet opening. The latch means is illustrated herein as a spring-lock 516 integrally formed into the lower portion of the left and right edges 510, 512 of the flipper door 500. The spring-locks 516 are generally constructed and arranged to cooperate with a catch plate 220 (FIG. 6) depending inwardly from the front portion of the inner surfaces of the left and right side panels 200, 300.

Referring to FIG. 6, the inner surface of the left side panel 200 is shown, illustrating the like-constructed tracks 218 integrally formed into the inner surface of the left and the right side panels 200, 300. The tracks 218 are constructed as inwardly depending tracks having a generally circular front portion 222 and a rearwardly extending upper track portion 224 and lower track portion 226 terminating in a rear stop portion 228. The lower track portion 226 extending rearwardly and about tangentially from the lower quadrant of the circular portion 222, and the upper track portion 224 extending rearwardly and generally parallel to the lower track portion. The circular front portion 222 is constructed and arranged to allow rotation of the cooperating D-shaped pin 514, and the rearwardly extending track portions 224, 226 operably engage the cooperating D-shaped pin to allow linear translation after upward rotation of the flipper door 500. The flat side of the D-shaped pin 518 cooperates with the upper track portion 224 and the radiused side of said D-shaped pin 520 cooperates with the lower track portion 226 to prevent rotation of the flipper door 500 during its linear translation.

Thus, a wall cabinet assembly with a flipper door comprised of injection molded components having integrated connectors which may be provided as a kit and assembled on a desired site has been shown and described.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A self-fastening wall cabinet comprising:

a bottom panel for enclosing a bottom portion of said wall cabinet, said bottom panel having an upper surface, a lower surface, a left end, and a right end, said left end including a first means of attaching said bottom panel to a left side panel in a perpendicular relationship, said right end including a first means of attaching said bottom panel to a right side panel in a perpendicular relationship;

a top panel for enclosing a top portion of said wall cabinet, said top panel having an upper surface, a lower surface, a left end, and a right end, said left end including a first means of attaching said top panel to a left side panel in a perpendicular relationship, said right end including a first means of attaching said top panel to a right side panel in a perpendicular relationship;

a back panel for enclosing a back portion of said wall cabinet, said back panel including a left end and a right end;

a left side panel for enclosing a left side portion of said wall cabinet, said left side panel including an inner surface and an outer surface, said inner surface including an integrally molded track extending from a front portion of said left side panel to a rear portion of said left side panel along an upper portion thereof, said inner surface including a second attachment means constructed and arranged to cooperate with said first attachment means for attaching said left side panel to said left end of said top panel and said bottom panel in a perpendicular relationship, and a third attachment means for attaching said left side panel to said left end of said back panel in a perpendicular relationship;

a right side panel for enclosing a right side portion of said wall cabinet, said right side panel including an inner surface and an outer surface, said inner surface including an integrally molded track extending from a front portion of said right side panel to a rear portion of said right side panel along an upper portion thereof, said inner surface including said second attachment means for attaching said right side panel to said right end of said top panel and said bottom panel in a perpendicular relationship, and said third attachment means for attaching said right side panel to said right end of said back panel in a perpendicular relationship;

a flipper door panel constructed and arranged for enclosing a front portion of said wall cabinet, said flipper door panel including an outer surface, an inner surface, a top edge, a bottom edge, a left edge, and a right edge, said left edge and said right edge each including a pivot means defining an axis of rotation therebetween and extending outwardly from an upper portion thereof, wherein said left edge pivot means is constructed and arranged to cooperate with said track of said left side panel and said right edge pivot means is constructed and arranged to cooperate with said track of said right side panel, wherein said left and said right side panel tracks and said pivot means cooperate to allow a lower portion of said flipper door panel to rotate about said axis to an essentially horizontal position when in a forward most position and thereafter slide inwardly in a generally parallel and adjacent manner to said lower surface of said top panel along said left and said right side panel tracks to an essentially juxtaposed position beneath said top panel thereby providing ingress into said wall cabinet;

wherein said wall cabinet can be shipped in a disassembled state and assembled on a desired site without a need for separate fasteners.

2. The wall cabinet as described in claim 1, wherein said flipper door panel pivot means includes a pair of axially aligned D-shaped outwardly extending pin members, said D-shaped pin members including a flat side and a radiused side, wherein one of said D-shaped pin members is integrally formed onto an upper portion of said left edge of said flipper door panel and one of said D-shaped pin members is integrally formed onto an upper portion of said right edge of said flipper door panel, wherein said D-shaped members cooperate with said left and said right tracks of said left side panel and said right side panel to allow said flipper door panel to rotate only while said flipper door panel is in a forward most position and said D-shaped members operably engage said left and said right track respectively to prevent rotation of said flipper door panel while said flipper door panel is slid rearwardly into said wall cabinet.

3. The wall cabinet as described in claim 1 wherein said tracks integrally molded into the inner surfaces of said left and said right side panels are constructed and arranged to accept D-shaped pin members which extend outwardly from each side of the left and right edges of the flipper door, wherein said left and said right tracks are constructed and arranged to cooperate with said D-shaped pin members to allow said flipper door panel to rotate only while said flipper door panel is in a forward most position with respect to said left and said right side panels and said left and said right tracks are constructed and arranged to prevent rotation of said flipper door panel while said flipper door panel is slid rearward with respect to said forward most position into said wall cabinet.

4. The wall cabinet as described in claim 3, wherein at least one of said tracks integrally formed into the inner surface of said left and said right side panels is constructed as an inwardly depending track, wherein said inwardly depending track has a generally circular front portion and two generally parallel rearwardly extending track portions terminating in a rear stop portion, wherein one of said rearwardly extending track portions is a lower track portion and one of said rearwardly extending track portions is an upper track portion, wherein said lower track portion extends rearwardly and tangentially from a lower quadrant of said circular portion.

5. The wall cabinet as described in claim 4, wherein said circular front portion of said track is constructed and arranged to allow rotation of said cooperating D-shaped pin member and said rearwardly extending track portions are constructed and arranged to allow linear translation of said cooperating D-shaped pin member after said rotation of said flipper door panel, wherein said flat side of said cooperating D-shaped pin member cooperates with said upper track portion and said radiused side of said D-shaped pin member cooperates with said lower track portion to prevent rotation of said flipper door panel during said linear translation of said flipper door panel.

6. The wall cabinet as described in claim 1, wherein said bottom panel and said top panel have a similar construction.

7. The wall cabinet as described in claim 1, wherein said first means for attaching said top and bottom panels to said left side panel and said right side panel includes a plurality of formed sockets arranged in a linear fashion along said left and right edges of said top and said bottom panels, and extending inwardly between said top surface and said bottom surface, said formed sockets being constructed and arranged to cooperate with said left and right side panels for interlocking engagement therebetween, wherein said top and said bottom panels are secured to said left and said right side panels via said formed sockets.

8. The wall cabinet as described in claim 7, wherein at least one of said formed sockets include an aperture therethrough, wherein said aperture is constructed and arranged to cooperate with at least one spring-tab, wherein said at least one spring tab is integrally formed onto the inner surface of said left and said right side panels, wherein said aperture and said at least one spring tab are constructed and arranged for mating engagement resulting in a mechanically secure connection between said left, top, and bottom panels.

9. The wall cabinet as described in claim 1, wherein said upper surface and said lower surface of said top and bottom panels include said third means for attaching, wherein said third means for attaching includes at least one groove extending between said left and said right ends and near a rear portion of said top and bottom panels, said at least one groove constructed and arranged to cooperate with said back panel for interlocking engagement therebetween;

wherein said grooves increase structural integrity of said wall cabinet by inhibiting said back panel from bowing or bending inwardly or outwardly, and wherein said back panel is secured within said wall cabinet.

10. The wall cabinet as described in claim 1, wherein said lower surface of said bottom panel includes integrally formed cross-bracing, wherein said cross-bracing provides increased weight capacity and stability to said wall cabinet.

11. The wall cabinet as described in claim 1, wherein said second means for attaching said left side panel to said top panel and said bottom panel includes a plurality of locking posts, wherein said locking posts are brought into an coupling engagement with corresponding formed sockets in said top panel and said bottom panel resulting in a mechanically secure connection between said left, top, and bottom panels.

12. The wall cabinet as described in claim 11 wherein said left side panel locking posts include at least one integrally formed spring-tab, wherein said at least one spring-tab is constructed and arranged to cooperate with said formed sockets for positively maintaining secure coupling engagement between said left, top, and bottom panels.

13. The wall cabinet as described in claim 1, wherein said second means for attaching said right side panel to said top panel and said bottom panel includes a plurality of locking posts, wherein said locking posts are brought into an coupling engagement with corresponding formed sockets in said top panel and said bottom panel resulting in a mechanically secure connection between said right, top, and bottom panels.

14. The wall cabinet as described in claim 13 wherein said right side panel locking posts include at least one integrally formed spring-tab, wherein said at least one spring-tab is constructed and arranged to cooperate with said formed sockets for positively maintaining secure coupling engagement between said right, top, and bottom panels.

15. The wall cabinet as described in claim 1 wherein said flipper door panel includes a latch means constructed and arranged for releasably securing said flipper door panel to said left and said right side panels.

16. The wall cabinet as described in claim 15 wherein said latch means includes at least one spring-lock integrally formed into a lower portion of said left and said right edges of said flipper door panel, said at least one spring lock constructed and arranged to cooperate with a catch plate depending from a front portion of said left and said right side panels for releasably securing said flipper door panel.

* * * * *